US007717720B2

(12) United States Patent
Ikeda

(10) Patent No.: US 7,717,720 B2
(45) Date of Patent: May 18, 2010

(54) ELECTRIC CONNECTION BOX

(75) Inventor: Tomohiro Ikeda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/414,369

(22) Filed: May 1, 2006

(65) Prior Publication Data

US 2007/0010123 A1 Jan. 11, 2007

(30) Foreign Application Priority Data

Jul. 11, 2005 (JP) ..... 2005-201209

(51) Int. Cl.
*H01R 12/00* (2006.01)

(52) U.S. Cl. ..... 439/76.2; 439/701

(58) Field of Classification Search ..... 439/374, 439/71, 70, 76.2, 701
See application file for complete search history.

(56) References Cited

U.S. PATENT DOCUMENTS 4,647,124 A * 3/1987 Kandybowski ..... 439/71
4,918,513 A * 4/1990 Kurose et al. ..... 439/73
RE33,268 E * 7/1990 Grabbe et al. ..... 439/70
5,186,642 A * 2/1993 Matsuoka et al. ..... 439/268
5,358,412 A * 10/1994 Maurinus et al. ..... 439/66
5,443,394 A * 8/1995 Billman et al. ..... 439/157
6,332,812 B1 * 12/2001 Kazuhara ..... 439/701
6,435,882 B1 * 8/2002 Pitou ..... 439/70
6,443,779 B2 * 9/2002 Suzuki ..... 439/701
7,101,195 B2 * 9/2006 Brooks ..... 439/70

FOREIGN PATENT DOCUMENTS

JP 2000-331759 11/2000

* cited by examiner

*Primary Examiner*—Truc T Nguyen
(74) *Attorney, Agent, or Firm*—Kratz, Quintos & Hanson, LLP

(57) ABSTRACT

An electric connection box having a main body, a guide wall disposed on the main body for retaining an electric component in a final connected state, and a protrusion disposed on an inner face of the guide wall for preventing movement of the electric component. The guide wall has flexibility and the protrusion contacts with the electric component, with the guide wall being bent outwardly when the electric competent is positioned in the final connected state. The electric connection box further includes a second cover having a locking member; wherein the locking member extends vertically and passes trough an aperture formed in the main body for engaging and locking the electric component.

6 Claims, 7 Drawing Sheets

ELECTRIC CONNECTION BOX

BACKGROUND OF THE INVENTION

1. Field of the Invention

The present invention relates to an electric connection box for preventing wear of heavy electric component terminals, such as a relay, and busbar terminals and trunk terminals in the electric connection box, due to movement of the electric component with vibration.

2. Description of the Related Art

FIG. 7 shows an embodiment of a conventional electric connection box (JP, 2000-331759,A).

The electric connection box 71 includes a relay 72, as an electric component, having relay male terminals 73, conductive trunk terminals 76 disposed between an upper cover 74 and a lower cover 75, and busbar boards 77 having busbars 78 with busbar male terminals 79. The relay male terminals 73 are connected with the busbar male terminals 79 through the trunk terminals 76.

The relay 72 turns on and off a main circuit with excitation of a coil in the relay against the busbars 78. The busbars 78 are strip-shaped conductive circuit bodies and have the busbar male terminals 79, which are formed by bending vertically end portions of the busbars 78. The upper cover 74 has a relay attachment portion 80 and a trunk terminal receiving room 81. A lower face of the relay 72 abuts to an upper face of the relay attachment portion 80. The lower cover 75 is fixed to the upper cover 74 and receives a plurality of the busbar boards 77 which are laminated each other.

Each busbar board 77 has the plurality of the busbars 78 separated by insulation substrates made of a synthetic resin. The trunk terminals 76 each have a pair of resilient contact pieces at an upper and lower portion of the vertical substrate. The relay male terminals 73 and busbar male terminals 79 are inserted between the substrate and the resilient contact pieces.

FIGS. 8 and 9 show another embodiment of a conventional electric connection box.

An electric connection box 82 includes an upper cover 83, a lower cover 3, guide walls 51, and flexible locking frames 53, which extend outwardly from the upper cover 83. The guide walls 51 have an L-shape and are arranged to be fitted with corners of the relay 6. The lower portions of the four corners of the relay 6 are guided by the guide walls 51 and locking protrusions 27 of the relay 6 are engaged with the locking frames 53. The relay 6 is usually for a high current and high voltage use.

The upper cover 83 and lower cover 3 are fitted together with flexible side locking frames 10 and side locking protrusions 11. The lower cover 3 has brackets 85 for fixing the lower cover 3 to a vehicle body. A middle plate 47 made of a synthetic resin is disposed above the lower cover 3. The busbars 86 are arranged on the middle plate 47 and between the middle plate 47 and the lower cover 3. Busbar male terminals 49 upstanding from the busbars 86 are connected to the relay male terminals 30 through the trunk terminals 48.

The trunk terminals 48 have resilient contact pieces 63 at middle portions thereof and contact walls 68, 69 opposed to the resilient contact pieces 63. The busbar male terminals 49 and relay male terminals 30 are connected together through the common resilient contact pieces 63.

In the conventional electric connection box 82 of FIGS. 8 and 9, as shown in FIG. 10, spaces S3 and S4 are formed in respective directions of X and Y between the guide walls 51 and the relay 6 when the relay 6 is attached to the relay attachment portion 84. Vibration of a vehicle at running or stopping moves the heavy relay 6 in the directions of X and Y, back and forth and leftward and rightward. This movement causes wears of the relay male terminals 30 and trunk terminals 48 and bends the resilient contact pieces 63 of the trunk terminals 48. As a result of that, the contact pressure between the relay male terminals 30 and the busbar male terminals 49 is reduced.

As shown in FIG. 11, the guide walls 51 are tapered for easy molding. An upper space S5 is larger than a lower space S6. Accordingly, the relay 6 swings inside the guide walls 51 in a direction of C and the relay male terminals 30 swing in a direction D. This movement accelerates the wear of the relay male terminals 30 and the trunk terminals 48 and the bending of the resilient contact pieces 63.

As shown in FIG. 9, there are other spaces S2 and S7 in a direction of Z for locking between the locking protrusions 27 and the locking frames 53 and between the side locking frames 10 and the side locking protrusions 11. An upper wall of the upper cover 83 is deformed with the weight of the relay 6 or the depression force of attachment of the relay 6. The spaces S2, S7 and the deformation of the upper cover 83 change a distance of H2 between an upper face of the lower cover 3, which contacts with the busbars, and a lower face of the relay 6 and a distance of H3 between an upper face of the middle plate 47, which contacts with the busbars, and the lower face of the relay 6. The large changes of H2 and H3 cause the wear of the relay male terminals 30, trunk terminals 48 and busbar male terminals 49.

When a large and heavy fusible link is utilized instead of the relay 6 and the relay male terminals 30 are directly connected to the busbar male terminals 86, not shown, without the trunk terminals 48, the same problems, such as the wear and bending, occur.

SUMMARY OF THE INVENTION

The present invention is to provide an electric connection box for preventing movement of an electric component such as a large size relay and bending of a main body thereof and ensuring a reliable electric connection between the electric component and mating terminals.

According to a first aspect of the present invention, an electric connection box includes a main body, a guide wall disposed on the main body for retaining an electric component, a protrusion disposed on an inner face of the guide wall for preventing movement of the electric component.

Preferably, the guide wall has an upper protrusion at an upper end portion thereof and a lower protrusion at a lower end portion thereof, and the upper protrusion extends toward the electric component more than the lower protrusion and contacts with or approaches to the electric component.

Preferably, the guide wall has flexibility and the protrusion contacts with the electric component with the guide wall being bent outwardly.

Preferably, the guide wall is higher than the center of gravity of the electric component and the protrusion is positioned above the center of gravity of the electric component.

According to a second aspect of the present invention, an electric connection box includes a first cover for retaining an electric component, and a second cover having a locking member, wherein the locking member extends vertically and passes through the first cover for locking the electric component.

Preferably, the second cover has a middle plate for arrangement of a busbar and said locking member extends vertically through the middle plate.

According to a third aspect of the present invention, an electric connection box includes: a main body having a first cover and a second cover; a guide wall disposed on the first cover for retaining an electric component; a protrusion disposed on an inner face of the guide wall for preventing movement of the electric component; and a second cover having a locking member, wherein the locking member extends vertically and passes through the first cover for locking the electric component.

DETAILED DESCRIPTION OF THE PREFERRED EMBODIMENTS

Figure 1:
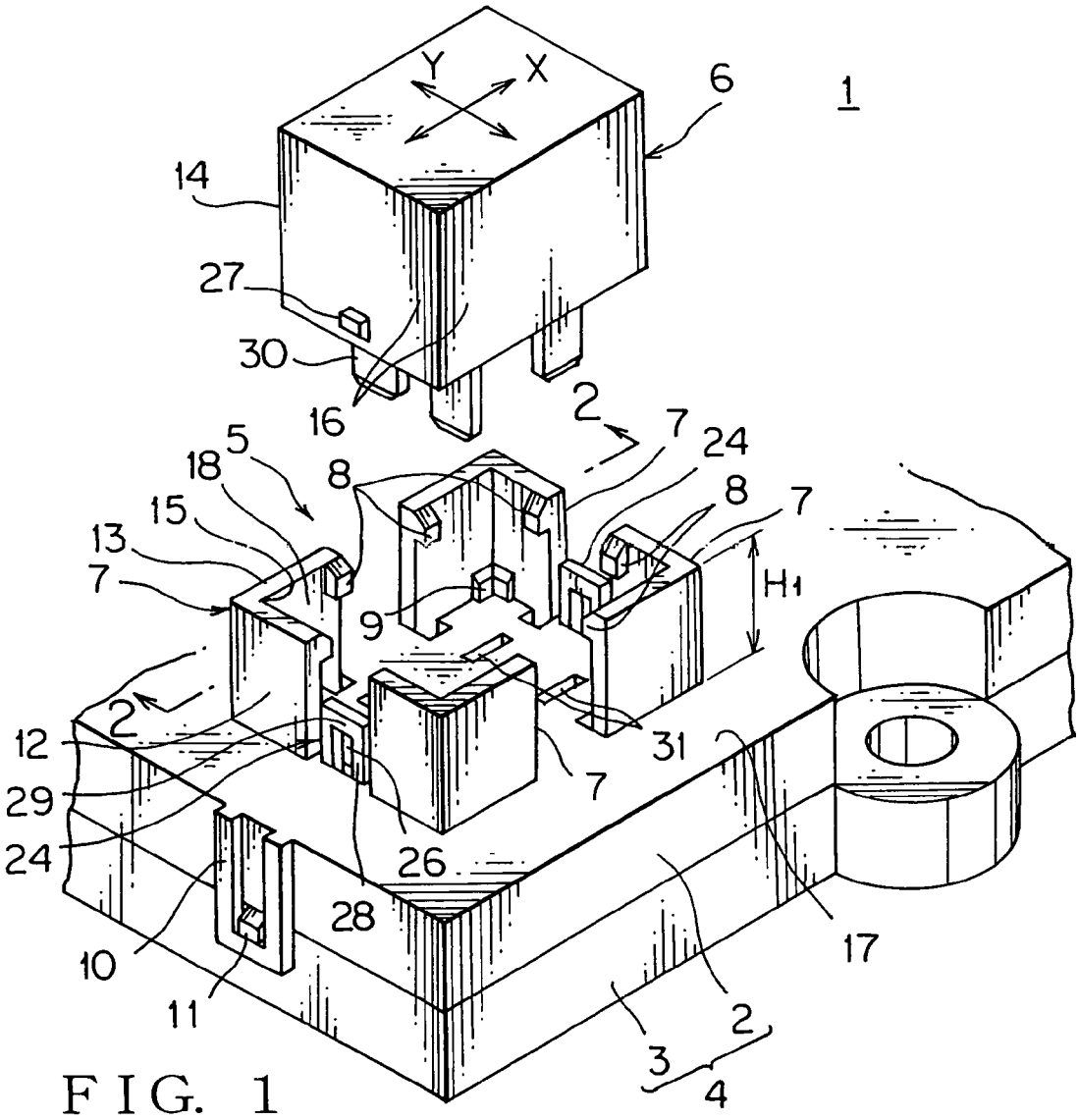
FIG. 1 is an exploded perspective view of a first embodiment of an electric connection box of the present invention.
Figure 2:
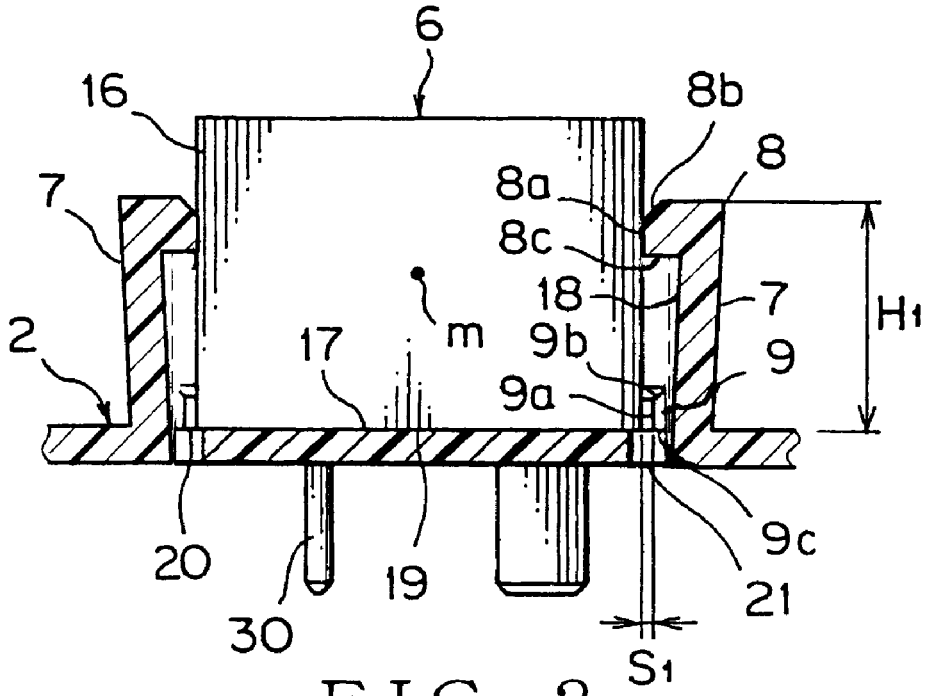
FIG. 2 is a sectional view of FIG. 1 taken along a line 2-2 of a main body retaining a relay.
Figure 3:
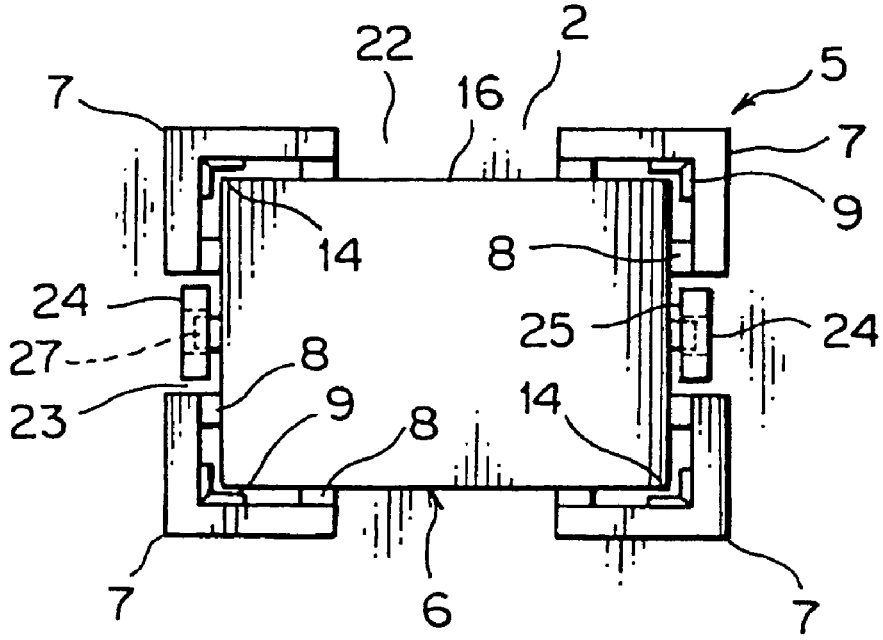
FIG. 3 is an essential plan view of the main body retaining the relay.

FIGS. 1-3 show an embodiment of an electric connection box of the present invention.

An electric connection box 1 includes a main body 4 and a relay attachment portion 5 (electric component attachment portion), which is made of a synthetic resin, disposed on the main body 4 for retaining a large size relay (electric component) 6, wherein the relay attachment portion 5 has guide walls 7, which have an L-shape and extend above the center of gravity of the relay 6. The guide walls 7 have upper protrusions 8 at upper end portions and lower protrusions 9 at lower end portions for preventing movement of the relay 6 and the upper protrusions 8 extend further toward the relay 6 more than the lower protrusions 9 extend.

Figure 9:
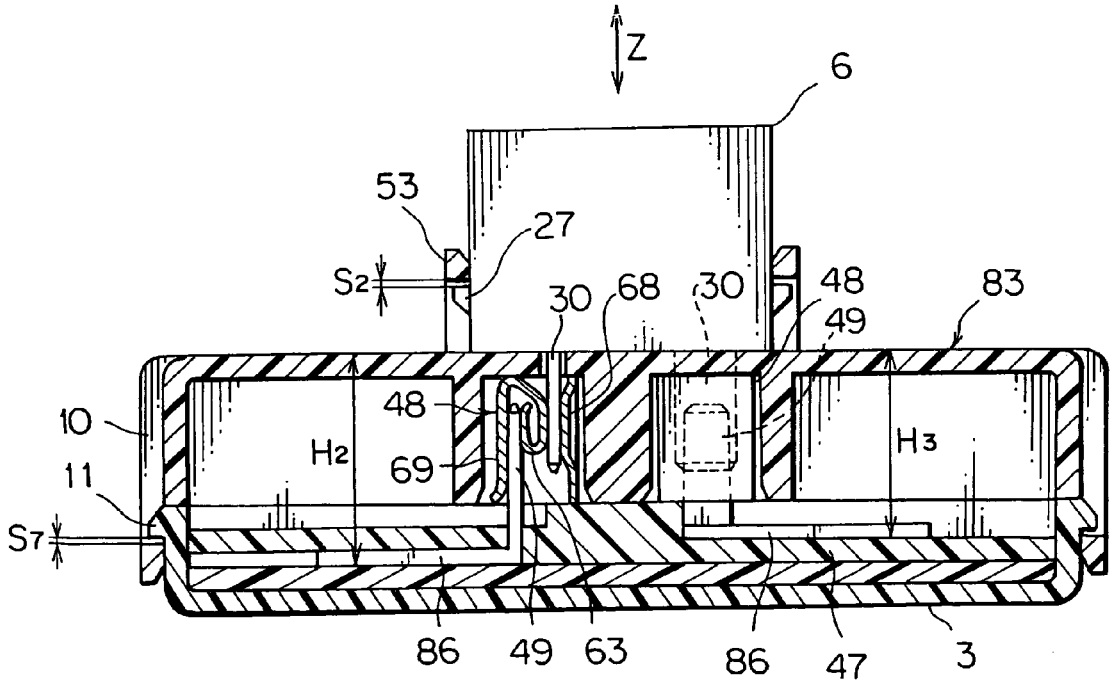
PRIOR ART FIG. 9
FIG. 9 is a vertical sectional view of the conventional electric connection box retaining a relay of FIG. 8.
Figure 8:
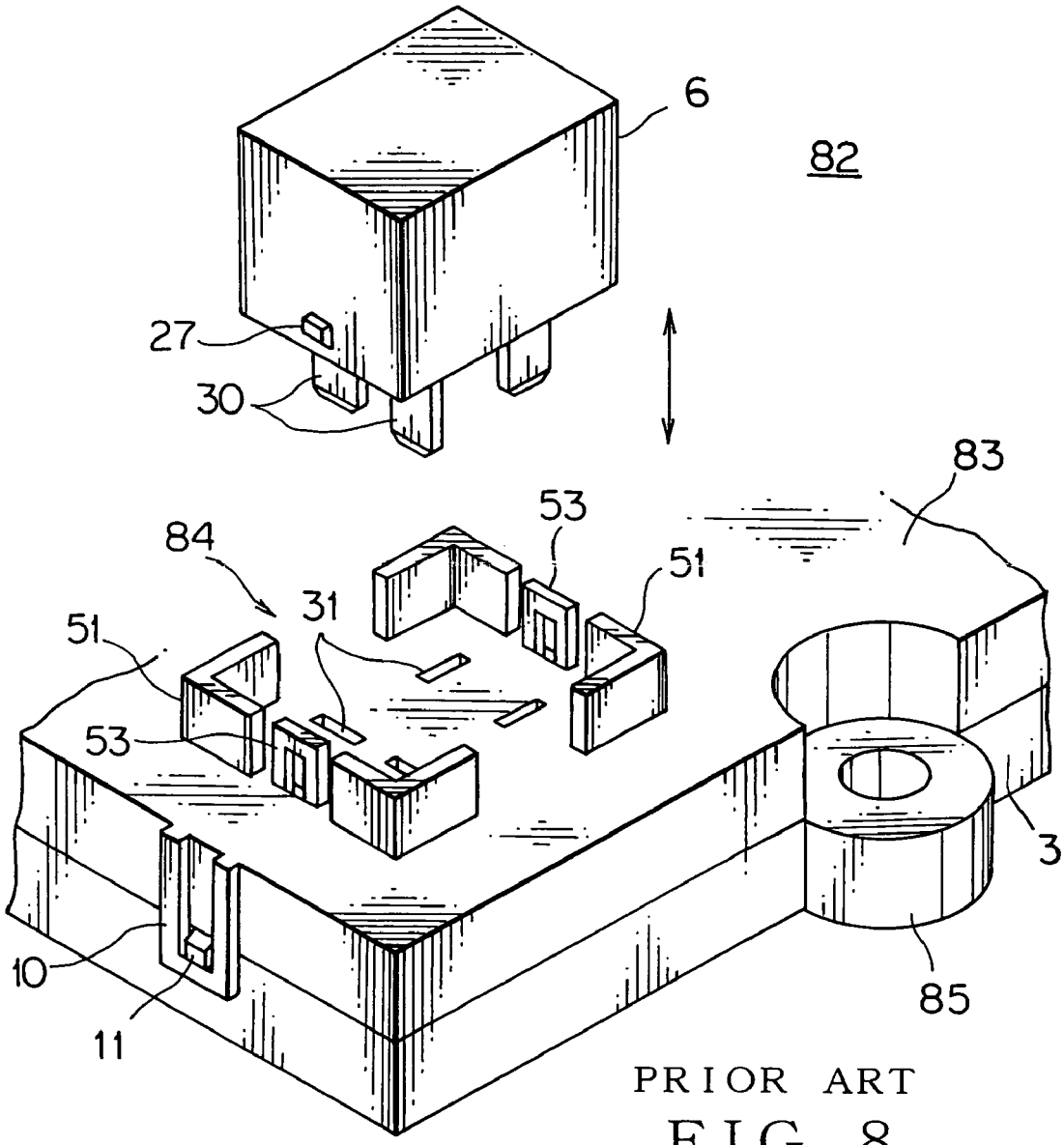
PRIOR ART FIG. 8
FIG. 8 is an exploded perspective view of another conventional electric connection box.
Figure 10:
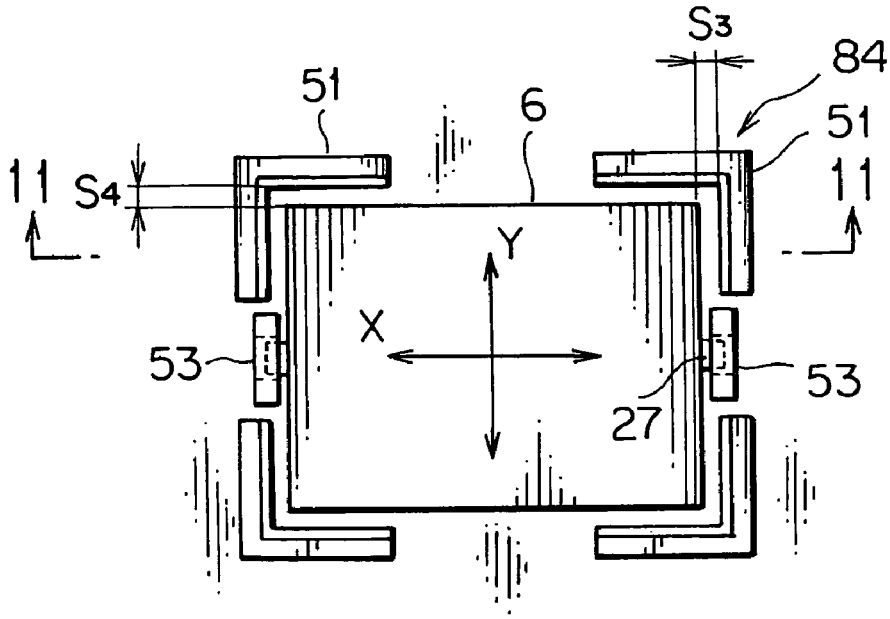
PRIOR ART FIG. 10
FIG. 10 is a plan view of a relay attachment portion of the conventional electric connection box of FIG. 8.

Since the majority of the components associated with the present invention is similar to those of the conventional electric connection boxes of FIGS. 8-9, like reference numerals are used for identification thereof. The embodiment of the present invention is to provide the electric connection box for preventing lateral movements (X and Y directions) of the relay 6.

The main body 4 has an upper cover 2 and a lower cover (base) 3. Both covers 2 and 3 are locked to each other with side locking frames 10 and side locking protrusions 11. Each guide wall 7 has side walls 12, 13 intersecting each other at a crossover portion 15 of the guide wall 7 and a height H1 of the guide wall 7 is higher than the center of gravity m of the relay 6 as shown in FIG. 2. As shown in FIG. 3, the guide walls 7 face to vertical edges 14 of the relay 6. The upper protrusions 8 are disposed at the upper end portions of the guide walls 7 and are opposed to each other about the crossover portion 15 and the lower protrusions 9 are disposed at the lower portions of the crossover portions 15.

As shown in FIGS. 1 and 2, the upper protrusions 8 extend horizontally longer than the lower protrusions 9 from inner faces 18 of the guide walls 7. As shown in FIGS. 2 and 3, the upper protrusions 8 contact with outer walls 16 of the relay 6 without a space and the lower protrusions 9 have a space S1 against the outer walls 16 of the relay 6. The guide walls 7 have a short width and a long height so that the guide walls 7 have flexibility in a direction of a thickness thereof and the upper protrusions 8 resiliently contact with the outer walls 16 of the relay 6 with the guide walls 7 being outwardly bent as shown in FIG. 2. In FIG. 2, dashed lines shown between the guide walls 7 and the outer walls 16 of the relay 6 indicate the disposition of the guide walls 7 when not outwardly bent, that is as the guide walls 7 would be disposed prior to placing the relay into the electric connection box which causes the guide walls 7 to bend outwardly.

Figure 11:
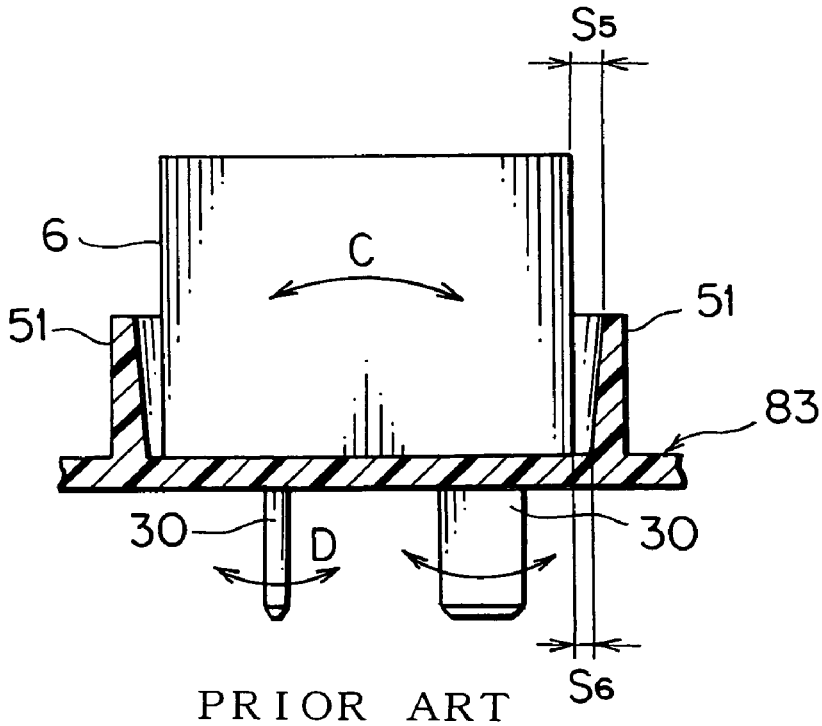
PRIOR ART FIG. 11
FIG. 11 is a sectional view taken along a line 11-11 of FIG. 10.

Lower portions of the guide walls 7 do not bend, or bend very small, and the spaces S1 are retained so that the relay 6 can be inserted assuredly into the guide walls 7 until the relay 6 abuts to an upper face 17 of the upper cover 2. When the relay 6 moves in the direction C as shown in FIG. 11, the outer walls 16 of the relay 6 contact with the lower protrusions 9 and the movement of the relay 6 is suppressed.

Outer faces 8*a* of the upper protrusions 8 may be aligned vertically with outer faces 9*a* of the lower protrusions 9 so that both protrusions 8 and 9 contact with the outer walls 16 of the relay 6 with the same contact pressure. As shown in FIG. 1, the lower protrusions 9 are disposed between the upper protrusions 8 so that die cutting is easily made.

The upper protrusions 8 are arranged at each side of the guide walls 7 so that the guide walls 7 stably retain the relay 16 with respect to directions of X and Y. The guide walls 7 each have the two upper protrusions 8 and one lower protrusion 9 for retaining the relay 6 with three-point mounting.

As shown in FIG. 2, the upper protrusions 8 are positioned above the center of gravity m of the relay 6 and retain the relay 6 above the center of gravity m thereof so that the movement of the heavy relay 6 in the X and Y, or lateral directions is assuredly prevented with the upper protrusions 8. Accordingly, wears of relay terminals 30, trunk terminals and busbar terminals due to the small movement are prevented and a deformation of resilient contact pieces of the trunk terminals is avoided.

The upper protrusions 8 at least contact with the outer walls 16 of the relay 6 so that, even when the guide walls 7 have a draft angle similarly to the conventional electric connection box as shown in FIG. 11, the movement of the relay 6 and the wear of all terminals are prevented.

The upper and lower protrusions 8 and 9 each have slopes 8*b* and 9*b* at the upper faces of the respective protrusions 8 and 9. The slopes 8*b* and 9*b* guide the relay 6 when the relay 6 is inserted into the guide walls 7. As shown in FIG. 2, lower faces 8*c* of the upper protrusions 8 and lower faces 9*c* of the lower protrusions 9 are perpendicular to the inner faces 18 of the guide walls 7. The lower protrusions 9 may be vertically connected to the upper face 17 of the upper cover 2.

Die cutting through holes 21 are disposed at the upper face 17 in vicinities of bottoms of the guide walls 7 for bending further the guide walls 7 so as that the upper protrusions 8 more assuredly abut to the relay 6. The lower protrusions 9 are disposed at the intersection of side walls 12, 13 of the guide walls 7 and have an L shape in a plan view.

As shown in FIG. 3, spaces 22 and 23 are disposed between the guide walls 7. The spaces 22 extending along the longitudinal direction of the relay 6 are utilized for attaching and detaching the relay with hand. Locking frames 24 extend vertically from the upper face 17 of the upper cover 2 and inner faces 25 thereof are about flush with the lower protrusions 9.

The guide walls 7 are higher than the locking frames 24 and the upper protrusions 8 are located above the locking frames 24. Each locking frame 24 has a pair of supporting pieces 28, a connecting piece 29 and a through hole 26. Locking protrusions 27 of the relay 6 engage with the through holes 26. When engaging, the locking frames 24 bend outwardly and return after engaging.

A middle plate and busbars (not shown) are disposed inside the main body 4 of the electric connection box 1 similarly to the conventional box as shown in FIG. 9. As shown in FIG. 1, through holes 31 for insertion of the relay male terminals 30 are disposed on the upper walls 17 of the upper cover 2 and inside the guide walls 7. The relay male terminals 30 are connected to the busbar male terminals (not shown) through the trunk terminals (not shown).

The relay male terminals 30 can be connected directly to the busbar male terminals without the trunk terminals. Relay female terminals (not shown) can be connected to the busbar male terminals.

Figure 4:
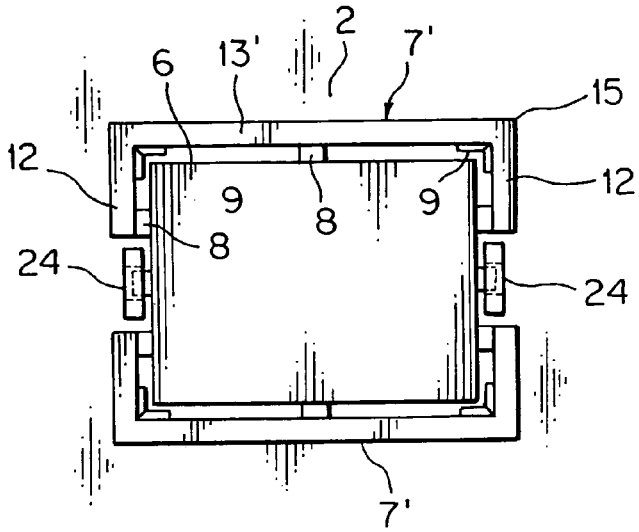
FIG. 4 is an essential plan view of a relay attachment portion of an electric connection box.

FIG. 4 shows a modification of the guide walls 7 of the upper cover 2. Detailed explanations are omitted for the like reference numerals of the embodiment of FIG. 1.

The spaces 22 are removed to form integral guide walls 7'. The upper protrusions 8 are disposed at middle portions of the walls 7'.

The another upper protrusions 8 of each guide wall 7' are kept at end portions of walls 12, namely close to the locking frames 24. The lower protrusions 9 of the guide walls 7' are disposed facing to the vertical edges 14 of the relay 6. The functions of the guide walls 7' and the protrusions 8 and 9 are the same as those of the first embodiment.

In the embodiments of FIGS. 1-4, the relay 6 can be square shaped instead of a rectangle. In this case, both side walls 12 and 13 have the same width and the upper protrusions 8 are positioned symmetrical with respect to the intersection of the side walls 12 and 13. This arrangement is also adapted to the rectangle shaped relay 6.

Although the upper and lower protrusions 8 and 9 are disposed on the guide walls 7 to prevent the movement of the relay 6, the upper protrusions 8 can only be disposed without the lower protrusions 9.

In the above embodiments, the upper protrusions 8 may have a space against the relay 6. It is preferable that the upper protrusions 8 extend toward the relay more than the lower protrusions 9.

In the above embodiments, the guide walls 7 are higher than the center of gravity m of the relay 6. The upper and lower protrusions 8 and 9 for preventing the movement of the relay 6 can be disposed at a height equal or below the center of gravity m of the relay 6. In this case, the protrusions can be disposed only at the upper portion or at the upper and lower portions of the guide walls.

The guide walls 7 can be disposed facing to the outer walls 16 of the relay 6 and have opening portions in vicinities of the vertical edges 14 of the relay 6. The upper and/or lower protrusions 8 an 9 can be disposed on all guide walls or main walls.

Figure 5:
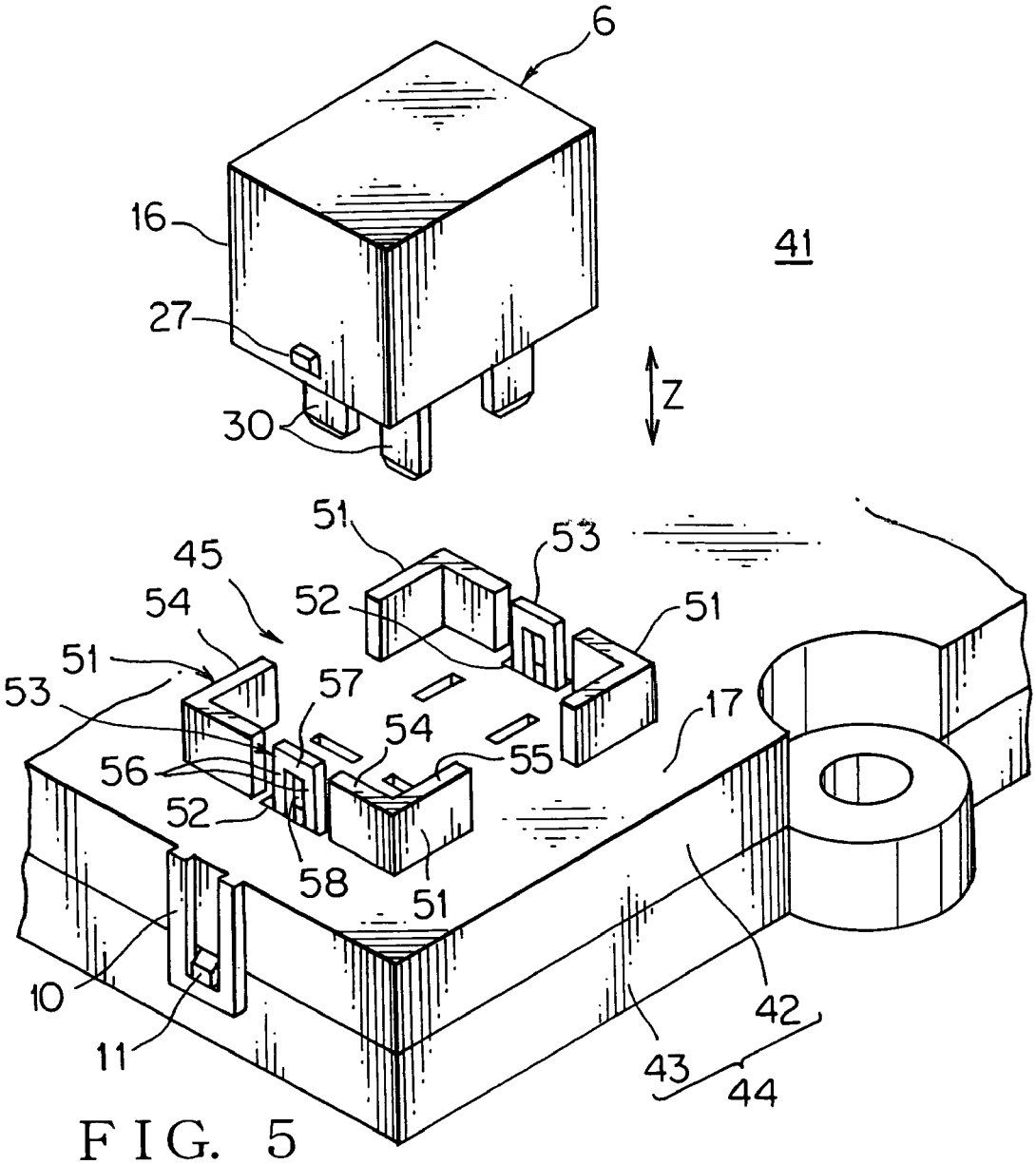
FIG. 5 is an exploded perspective view of a second embodiment of an electric connection box of the present invention.
Figure 6:
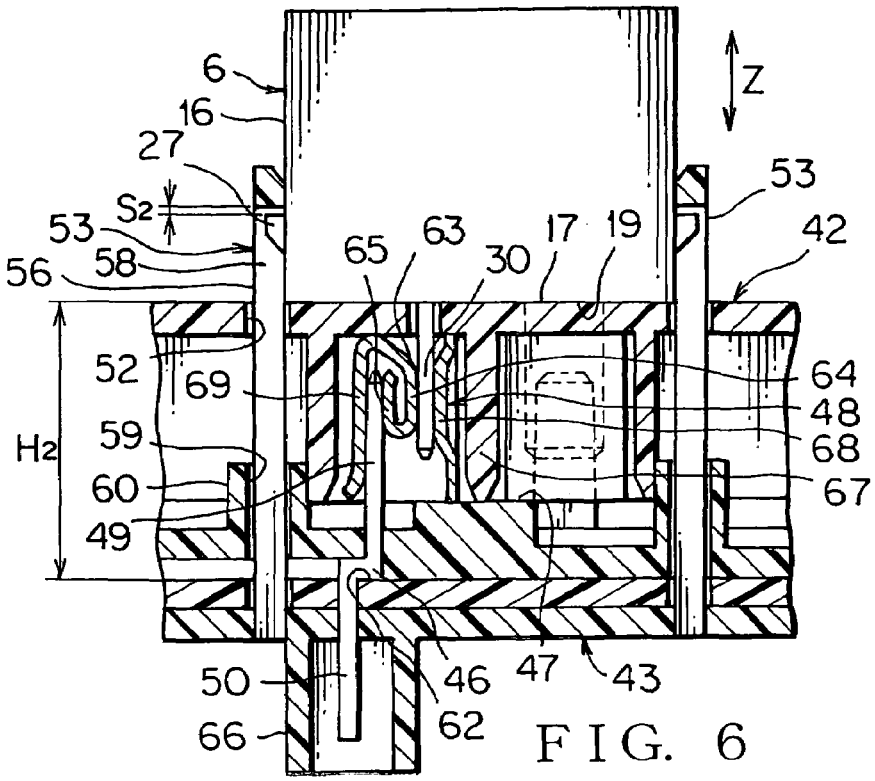
FIG. 6 is an essential sectional view of the electric connection box retaining a relay.

FIGS. 5 and 6 show a second embodiment of the electric connection box of the present invention. The explanation to the like reference numerals of the first embodiment is omitted.

An electric connection box 41 includes a main body 44 having an upper cover (first cover) 42 and a lower cover (second cover) 43, a middle plate 47, which is made of an insulation synthetic resin, disposed inside the main body 44, conductive busbars 46 disposed along the middle plate 47 and the lower cover 43, and a relay 6 attached to a relay attachment portion (electric component attachment portion) 45 and connected to vertical busbar male terminals 49 through trunk terminals 48. Flexible locking frames (locking members) 53 to be engaged with locking protrusions 27 of the relay 6 are disposed on the lower cover 43 instead of the upper cover 42. The locking frames 53 extend vertically from the lower cover 43 and pass through the middle plate 47 and the upper cover 42.

The other structure of this embodiment is almost same as that of the conventional electric connection box of FIGS. 8 and 9.

As shown in FIG. 5, four guide walls 51 are upstanding on an upper face 17 of the upper cover 42. Each guide wall 51 has side walls 54 and 55 which are intersecting to each other. A pair of through holes 52 are disposed on the upper face 17 surrounded by the guide walls 51 and the locking frames 53 extend vertically and pass through the through holes 52.

In this embodiment, the protrusions 8 and 9 for preventing the movement of the relay 6 are not disposed in the guide walls 51 and the guide walls 51 are lower than the guide walls 7 of the first embodiment. The higher walls 51 and the attachment of the protrusions 8 and 9 are also effective and prevent the movement of the relay 6 in X, Y and Z directions.

Each long locking frame 53 has a pair of supporting pieces 56, a connecting piece 57 connected to the each supporting piece 56, and a through hole 58 surrounded by the supporting and connecting pieces 56 and 57. As shown in FIG. 6, the supporting pieces 56 and the through hole 58 of the each locking frame 53 extend from the lower cover 43 and pass through the upper cover 42. The through hole 58 communicates with an opening of the lower cover 43. The locking frames 53 are formed integrally with the lower cover 43.

Through holes 59 and 52 are formed in the middle plate 47 and the upper cover 42 for the locking frames 53 to be flexible in a direction of a thickness thereof over the entire length. Bosses 60 are disposed around the through holes 59 of the middle plate 47 and suppress bending of the locking frames 53.

The through holes 59 of the middle plate 47 and through holes 53 of the upper cover 42 can be a narrow width so as to hold the long locking frames 53 without clearances. The through holes 52 of the upper cover 53 can be a supporting point for flexure of the locking frames 53. The through holes 53 of the locking frames 53 can be formed only above the upper cover 42 for flexure of the locking frames 53 so as to suppress the flexure of the locking frames 53 and also the movement of the relay 6.

The locking frames 53 can be replaced with flexible locking arms (not shown), which are disposed on the lower cover 43. The locking arms have locking protrusions at tips thereof and the locking protrusions engage with upper faces of the locking protrusions 27 of the relay 6 or locking recesses (not shown) disposed on the outer walls 16 of the relay 6. The locking frames 53 or locking arms can be disposed on the middle plate 47 instead of the lower cover 43.

As shown in FIG. 6, when the locking frames 53 are disposed on the lower cover 43 for locking the relay 6, a distance H2 of between the lower face 19 of the relay 6 and the upper face 62 of the lower cover 43 only varies with a locking space S2 of between the locking protrusions 27 of the relay 6 and the locking frames 53. The movement of the relay 6 is not affected by locking spaces between the side locking frames 10 and side locking protrusions 11 and bending of the upper cover 42 due to the relay 6 depressed. Accordingly, the distance H2, or the vertical movement (Z direction) of the relay 6 is suppressed. Then, the wear of the relay male terminals 30 and the resilient contact pieces 63 at contact points 54 are reduced. The wear of the busbar male terminals 49 and resilient contact pieces 63 at contact points 65 are also reduced. When the locking spaces S2 are set to nearly zero, the wear due to the vertical movement of the relay 6 is completely suppressed.

These effects are also achieved by the locking arms. When the locking frames 53 are disposed on the middle plate 47 instead of the lower cover 43, since the distance H2 varies due to the change of the locking spaces between the side locking means 10 and 11, the effect of reducing the wear of the terminals decreases compared to the case of that the locking frames 53 are disposed on the lower cover 43. There is no bending on the upper face 17 of the upper cover 42 due to the relay 6 depressed so that the wear protection is better than the conventional electric connection box.

As shown in FIG. 6, the busbars 46 have busbar male terminals 50 extending downwardly. The busbar male terminals 50 are positioned in connector housings integral with the lower cover 43 and form connectors 66. Connectors of external wiring harnesses or electric components (not shown) are connected to the connectors 66.

The upper face of the lower cover 43 contacts with the lower face of the middle plate 47. The upper face of the middle plate contacts with lower ends of trunk terminal receiving walls 67 of the upper cover 42. Each relay male terminal 30 is inserted into between the respective resilient contact piece 63 and a contact wall 68 of the trunk terminal 48. Each busbar male terminal 49 is inserted into between the contact wall 69 and resilient contact piece 63. Other busbars, not shown, are disposed between the lower cover 43 and the middle plate 47 or disposed on the upper face of the middle plate 47.

The second embodiment of FIGS. 5 and 6 can also be adapted to the first embodiment of FIG. 1 to 4 so that the movement of the relay 6 toward the longitudinal and lateral directions are suppressed and the wears of the relay male terminals 30, trunk terminals 48 and busbar male terminals 49 are prevented.

Figure 7:
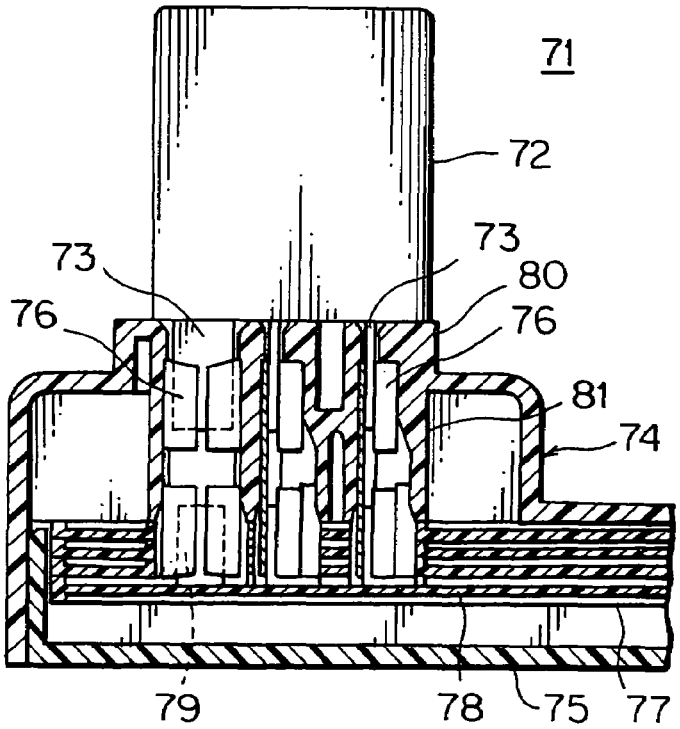
PRIOR ART FIG. 7
FIG. 7 is a sectional view of a conventional electric connection box.

In the second embodiment, it is possible to dispose only the locking frames (locking member) 53 without the guide walls 51 similarly to the prior art of FIG. 7.

The locking means between the upper cover 42 and the lower cover 43 of the first and second embodiments are not limited to the exemplary cases of FIGS. 1 and 5 and can be modified in any means.

The operating effects described above are also pertinent to the electric connection boxes when they are disposed vertically or obliquely. In this case, the lateral and longitudinal directions correspond to the vertical and horizontal directions, respectively.

The invention claimed is:

1. An electric connection box comprising:

a main body;

a guide wall disposed on the main body for retaining an electric component in a final connected state; and an upper protrusion disposed at an upper end portion and a lower protrusion disposed at a lower end portion on an inner face of the guide wall for preventing movement of the electric component, wherein said guide wall has flexibility and the upper protrusion contacts with outer walls of the electric component with the guide wall being bent outwardly when said electric component is positioned in the final connected state.

2. The electric connection box as claimed in claim 1, wherein said guide wall has the upper protrusion at an upper end portion thereof and lower protrusion at a lower end portion thereof, and the upper protrusion extends toward the electric component more than the lower protrusion.

3. The electric connection box as claimed in claim 1, wherein said guide wall is higher than the distance measured from the main body to the center of gravity of the electric component and the protrusion is positioned above the center of gravity of the electric component.

4. An electric connection box comprising:

a first cover for retaining an electric component by contacting the electric component; and a second cover having a locking member as an integral portion thereof for engaging a through hole of the locking member with a locking protrusion of an outer wall of the electric component, wherein the locking member extends vertically and passes through an aperture formed in the first cover for engaging and locking the electric component.

5. An electric connection box comprising:

a first cover for retaining an electric component;

a second cover having a locking member as an integral portion thereof for engaging a through hole of the locking member with a locking protrusion of an outer wall of the electric component; and a middle plate for arrangement of a busbar;

wherein the locking member extends vertically and passes through an aperture formed in the first cover for engaging and locking the electric component, and wherein said locking member extends vertically and passes through an aperture formed in the middle plate.

6. An electric connection box comprising:

a main body having a first cover and a second cover;

a guide wall disposed on the first cover for retaining an electric component, said guide wall having flexibility;

a protrusion disposed on an inner face of said guide wall for preventing movement of the electric component; and said second cover having a locking member as an integral portion thereof for engaging the electric component, wherein the locking member extends vertically and passes through said first cover for engaging and locking the electric component, and said guide wall is bent outwardly when said electric component is positioned in a final connected state.

* * * * *